US005837122A

United States Patent [19]

Snyder et al.

[11] Patent Number: 5,837,122

[45] Date of Patent: Nov. 17, 1998

[54] ELECTROWINNING ELECTRODE, CELL AND PROCESS

[75] Inventors: Thomas Stephen Snyder, Oakridge; John Gregorie Wagner, Harriman, both of Tenn.

[73] Assignee: The Scientific Ecology Group, Inc., Oak Ridge, Tenn.

[21] Appl. No.: 837,614

[22] Filed: Apr. 21, 1997

[51] Int. Cl.[6] ..... C25D 21/18; C25D 17/20

[52] U.S. Cl. ..... 205/560; 205/687; 204/237; 204/263; 204/275; 204/283; 204/284; 204/294

[58] Field of Search ..... 204/242, 283, 204/284, 252, 237, 263, 275, 294; 205/560, 687, 704

[56] References Cited

U.S. PATENT DOCUMENTS

| | | | |
|---|---|---|---|
| 3,853,725 | 12/1974 | Skarbo | 204/112 |
| 4,370,214 | 1/1983 | Kadija | 204/242 |
| 4,401,519 | 8/1983 | Kadija et al. | 204/284 X |
| 4,515,672 | 5/1985 | Plater et al. | 204/284 |
| 4,643,819 | 2/1987 | Heroguelle | 204/284 X |
| 4,680,100 | 7/1987 | Morin | 204/242 X |
| 4,789,450 | 12/1988 | Paterson | 204/284 X |
| 4,792,385 | 12/1988 | Snyder et al. | 204/140 |
| 5,156,722 | 10/1992 | Snyder et al. | 204/112 |
| 5,183,541 | 2/1993 | Snyder et al. | 204/105 R |
| 5,217,585 | 6/1993 | Snyder et al. | 204/112 |
| 5,262,019 | 11/1993 | Snyder et al. | 204/105 R |
| 5,439,562 | 8/1995 | Snyder et al. | 204/1.5 |
| 5,690,806 | 11/1997 | Sunderland et al. | 205/560 |

*Primary Examiner*—Donald R. Valentine
*Attorney, Agent, or Firm*—John R. Lane, Esq.

[57] ABSTRACT

An inexpensive electrowinning electrode has a cathode that is a porous form made from conductive filaments, and an anode. The electrowinning process dissolves a contaminated metal stream into an electrolyte to form a solution flow of dissolve metal and contaminants. Next, the solution is oxidized. Then, the dissolved metals in the solution are plated onto the porous cathode.

18 Claims, 3 Drawing Sheets

ELECTROWINNING ELECTRODE, CELL AND PROCESS

BACKGROUND OF THE INVENTION

This invention relates to the plating of dissolved metals from a stream.

The prior art teaches decontaminating transition metals, such as nickel, copper, cobalt, and others, by electrorefining and electrowinning arts. In the electrowinning arts, the critical issue is the dimensional stability of the inert anode. Graphite is often used for the anode as it is inexpensive and easily disposed of through incineration.

However, the graphite anode disintegrates during use and contaminates the metal being plated on the cathode. Submicron particles of graphite separate from the anode and migrate through the electrowinning process. During the migration, the particles adsorb contaminants—such as Tc—and deposit on the cathode, thus contaminating it.

A step to improve the graphite anode stability has been to use exotic coatings, such as iridium oxide on base titanium. This coating solves the stability problem, but creates a new problem of these coatings adding additional costs to the system.

Another drawback of the prior art is the inability to reduce the electrowinning cell size. The cell size is a function of the cathode surface area/volume, the diffusion distance, and the solution turbulence. Current cathode design has conductive parallel plate electrodes disposed in the solution flow. This design is limited in how compact the cell can be in that plates have relatively low surface area/volume, high diffusion distances, and low solution turbulence with tightly spaced plates.

The prior art discloses using seed cathodes to improve the cathode surface area/volume, the diffusion distance, and the solution turbulence. However, the seed cathodes are costly to fabricate.

Therefore, a need exists for an inexpensive electrowinning electrode that is compact and has improved the cathode surface area/volume, the diffusion distance, and the solution turbulence generation properties.

SUMMARY OF THE INVENTION

The claimed invention provides an inexpensive electrowinning electrode with improved cathode surface area/volume, diffusion distance, and solution turbulence generation properties, and an improved electrowinning process. The electrode has a cathode that is a porous form made from conductive filaments, and an anode. The electrowinning process dissolves a contaminated metal stream into an electrolyte to form a solution flow of dissolved metal and contaminants. Next, the solution is oxidized. Then, the solution's dissolved metals are plated onto the porous cathode.

DETAILED DESCRIPTION OF THE PREFERRED EMBODIMENTS

Figure 1:
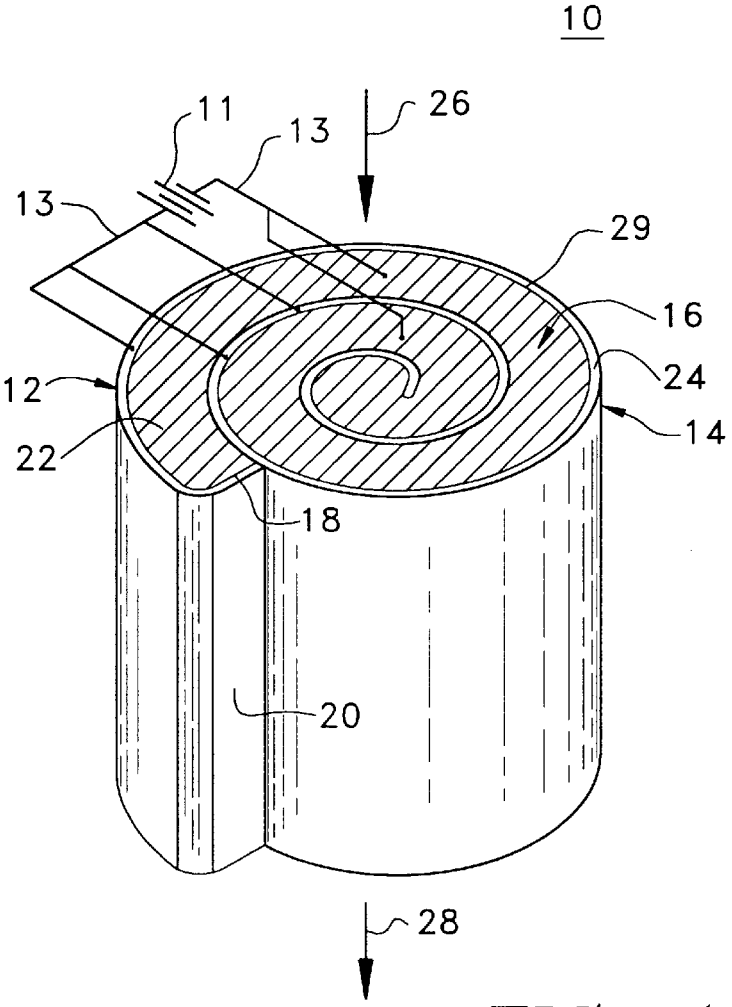
FIG. 1 is an isometric view of an electrode/electrowinning cell having a spiral of Archimedes latitudinal cross-section according to an embodiment of the invention.

Now referring to the figures, wherein like reference numerals refer to like elements, and in particular to FIG. 1, an electrode 10 functions as a combined electrode and electrowinning cell. The electrode 10 has a cathodic chamber 12 and an anodic chamber 14. The cathodic chamber 12 has a cathode 22 comprised of a porous form of conductive filaments. The filaments may be wire, mesh, or matte. The mesh filaments may be screening or webbing. The matte filaments may be woven, plaited, or felted material. The porous cathode 22 may be made by packing the cathodic chamber 12 with the filaments or preforming the filaments into a shape that fits in the chamber. The preformed filament shape may be a porous weave or stacked layers of the mesh and/or matte filaments. The anodic chamber 14 comprises an anode 24. A power source 11 generates a potential between the two chambers via conduit 13 to perform the electrowinning process.

When using the electrode 10, a solution flow 26 having dissolved metals is directed through the cathodic chamber 12 and the dissolved metals plate onto the filaments of the porous cathode 22. A clean stream 28 exits the electrode 10. The porous cathode 22 provides a large amount of cathode surface area per volume, permitting cell minimization. The filaments of the cathode 22 also provide a small diffusion distance and increased turbulence for the solution, further contributing to cell minimization and also permitting enhanced plating for a cleaner clean stream 28 exiting the electrode 10. To restrict cathode contamination to a limited area, the cathode 22 traps foreign objects in a surface layer and keeps the objects away from the bulk of the cathode.

During the plating process, the porosity of the cathode 22 drops as more metal is plated on it. The cathode is harvested once the porosity of the cathode 22 has dropped such that it is ineffectual. In an embodiment of the invention, the porosity of the cathode may be measured as a function of the pressure drop of the solution flow 26 through the cathode. Once the pressure drop is above a harvest limit, the cathode is harvested.

In a preferred embodiment, the anode 24 is comprised of graphite in forms such as felt, rods, or powder. A graphite anode is preferred because it is relatively cheap and may be disposed by incineration. However, the graphite anode disintegrates with use. The disintegrated graphite becomes trapped in the porous cathode 22 and contaminates the plated metal. In a preferred embodiment, one or more semipermeable membranes 29 may be disposed between the anode 24 and the porous cathode 22 to prevent the disintegrated graphite from passing into the cathodic chamber 12 and contaminating the cathode. Other embodiments of the invention may use other anode materials.

In the embodiment of FIG. 1, the anodic chamber 14 of the electrode 10 has been rolled around itself such that it has a spiral of Archimedes latitudinal cross-section. With this configuration, the anode 14 forms a spiral channel 16 with an outer edge 18 sealed by an end portion 20. The cathodic chamber 12 is disposed in the spiral channel 16. With this arrangement, the electrode 10 forms it own electrowinning cell with the solution flow 26 passing through the cathodic chamber 12 and the porous cathode 22.

Figure 2:
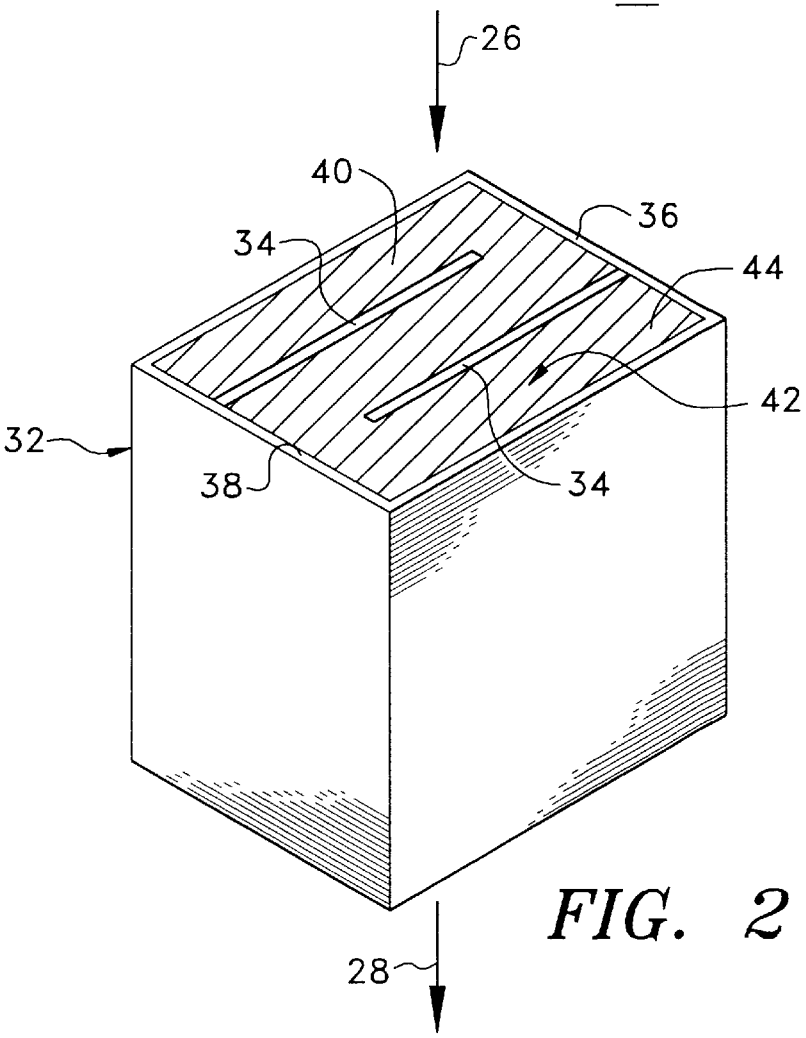
FIG. 2 is an isometric view of an electrode/electrowinning cell having a square latitudinal cross-section according to an embodiment of the invention.
Figure 3:
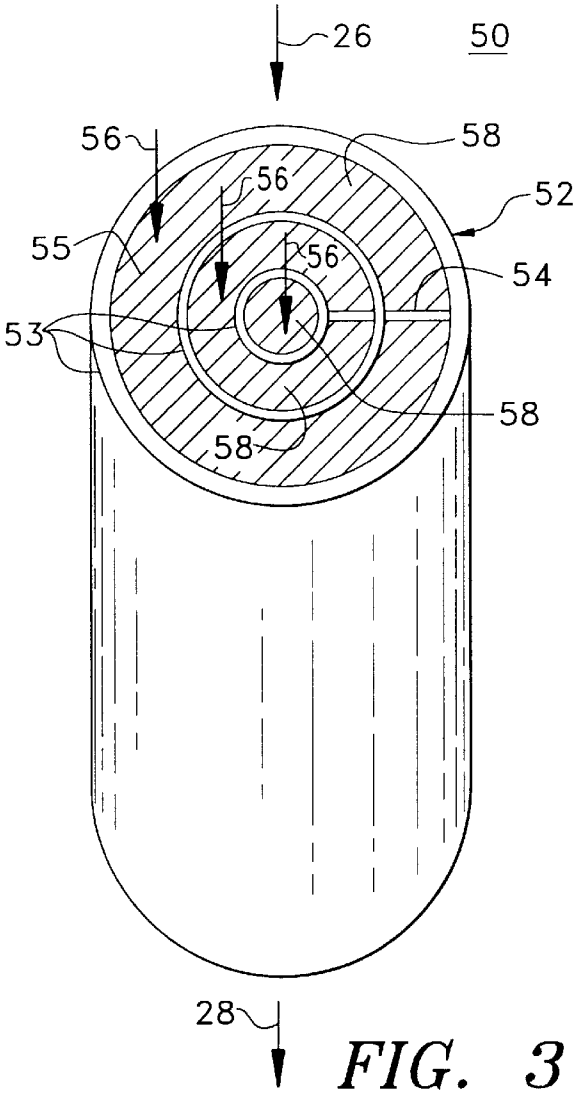
FIG. 3 is an isometric view of an an electrode/electrowinning cell having a round latitudinal cross-section according to an embodiment of the invention.

Referring now to FIGS. 2 and 3, other embodiments of the invention may have combined electrode/electrowinning cells of other suitable configurations. Electrode 30 has an anodic chamber 32 that is a square tube with members 34 partially extending between opposing sides 36 and 38. The anodic chamber 32 forms a channel 40 in which is disposed a cathodic chamber 42. The cathode 44 of the cathodic chamber 42 is comprised of a porous form of conductive filaments. Electrode 50 has an anodic chamber 52 that is concentric cylinders 53 connected with a cross member 54. The anodic chamber 52 forms a set of annular channels 56 in which are disposed cathodic chambers 58. As with the previous electrodes 10 and 30, the solution flow 26 passes through the cathodic chamber 58 that has a cathode 55 comprised of a porous form of conductive filaments.

Figure 4:
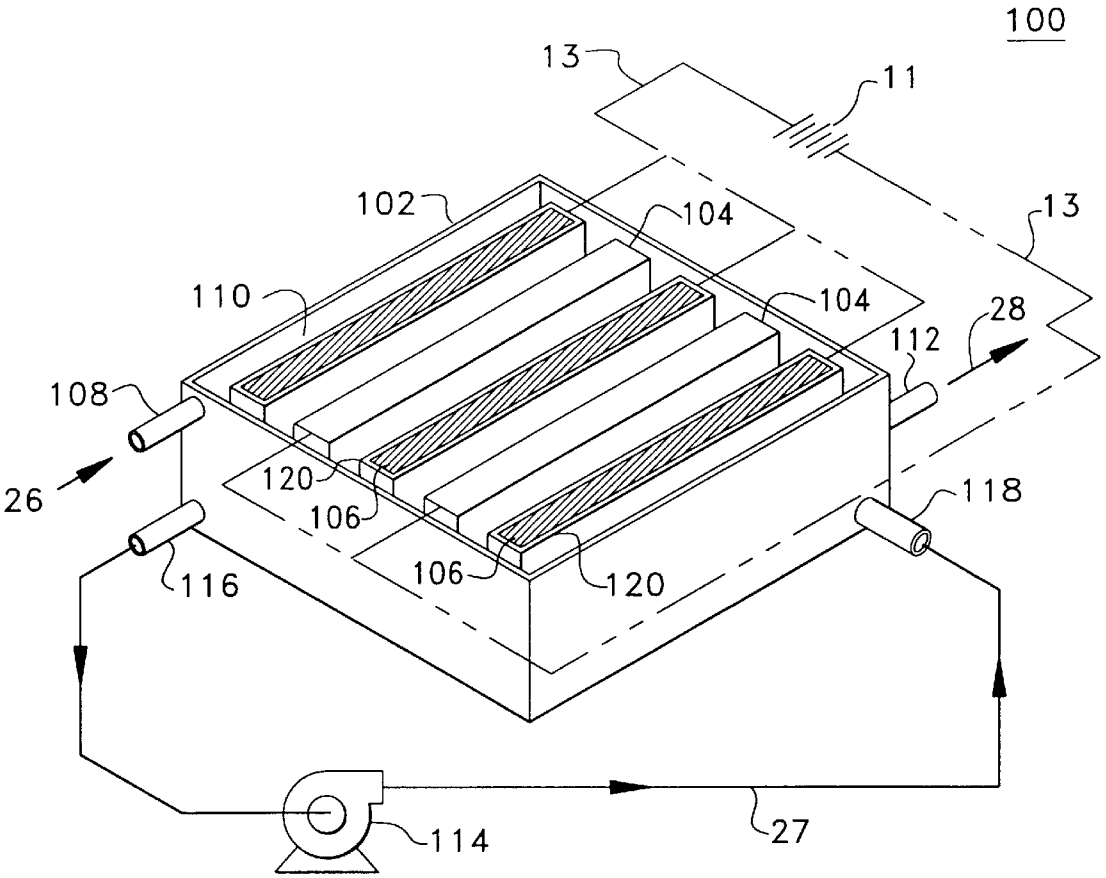
FIG. 4 is an isometric view of an electrowinning cell with plate-shaped anodes and porous, plate-shaped cathodes according to an embodiment of the invention.

Now referring to FIG. 4, an alternative embodiment of the invention is an electrowinning cell 100 comprising a vessel 102, planar cathodes 104, and planar anodes 106. The planar cathodes 104 are comprised porous plates of conductive filaments. The planar anodes 106 are comprised of graphite in the shape of a plate. The porous, planar cathodes 104 and planar anodes 106 are alternatingly oriented side by side in the vessel 102. Other embodiments of the invention may have other suitable arrangements of the anodes and porous cathodes. The walls of the vessel 112, the cathodes, and the anodes define voids 110. In a preferred embodiment of the invention, semipermeable membranes 120 surround the anodes 106 to inhibit disintegrating anode material from contaminating the cathodes.

In the electrowinning cell 100, the solution flow 26 enters the vessel 102 through an inlet 108. The solution flow 26 moves through the voids 110 and the porous, planar cathodes 104 to enable the dissolved metals to plate onto the cathodes. The clean stream 28 exits the vessel through an outlet 112. To aid in increasing the turbulence in the vessel 102, a recirculation pump 114 withdraws a portion of the solution flow 26 from the vessel 102 through a port 16 and injects it back into the vessel through a port 118.

Figure 5:
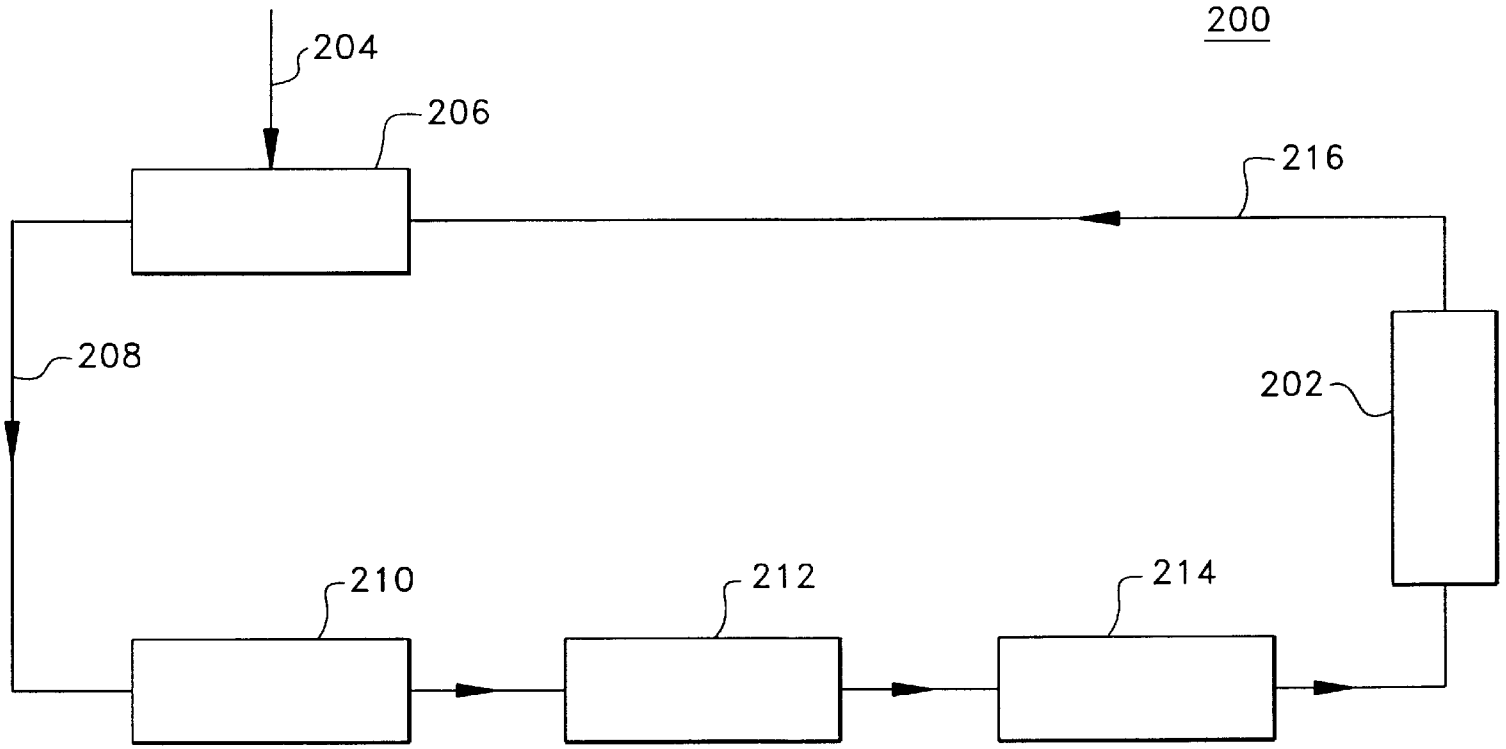
FIG. 5 is flow chart of an electrowinning system according to an embodiment of the invention.

Now referring to FIG. 5, electrowinning electrodes, whether electrodes 10, 30, 50, 100, or an equivalent substitute, are used in an electrowinning cell 202 of an electrowinning process 200. The process 200 starts with a contaminated metal stream 204 being dissolved in an anodic dissolution cell 206 with an electrolyte to form a solution flow 208 of metal and contaminants. The solution flow 208 is then oxidized in an oxidation tank 210 to adjust the potential of the flow. The oxidation may be done with ozone, hydrogen peroxide, ultraviolet light, combinations of the three, or by other suitable means. The solution flow 208 is then stripped of the oxidant, if required, in the oxidant stripper 212. If Tc is present, the flow 208 is then directed through an ion exchanger 214 before going through the cell 202. The metal in the solution flow 208 plates out on the porous cathodes in the electrowinning cell 202, producing a clean stream 216. The clean stream 216 is directed into the anodic dissolution cell 206 to be used as the electrolyte for dissolving the contaminated metal stream 204. Other electrowinning process configurations are disclosed in U.S. Pat. Nos. 3,853,725; 5,156,722; 5,183,541; 5,217,585; 5,262,019; and 5,439,562, all of which are incorporated by reference herein in their entireties.

Any type of plateable metal dissolved in a solution stream may be electrowon using the present invention. Further, the cells may be constructed to vent anodically and cathodically formed gases. Consequently, the present invention may be embodied in other specific forms without departing from the spirit or essential attributes thereof and, accordingly, reference should be made to the appended claims, rather than to the foregoing specification, as indicating the scope of the invention.

We claim:

1. An electrode/electrowinning cell comprising:

a) an anode which defines a channel; and b) a cathode which is disposed in said channel and is comprised of a porous form of one or more conductive filaments;

wherein said anode has a spiral of Archimides latitudinal cross-section.

2. The electrode/electrowinning cell according to claim 1, wherein said conductive filaments are wire, mesh or matte.

3. The electrode/electrowinning cell according to claim 2, comprising at least one semipermeable membrane being disposed between said cathode and anode.

4. The electrode/electrowinning cell according to claim 3, wherein said anode is comprised of graphite.

5. The electrode/electrowinning cell according to claim 4, wherein said graphite is in the form of felt, rods or powder.

6. The electrode/electrowinning cell according to claim 1, which is disposed in an electrowinning dissolution system.

7. An electrowinning cell comprising a vessel in which is disposed a plate-shaped anode and a plate-shaped cathode wherein said cathode is comprised of a porous film of one or more conductive filaments and said plates are oriented side-by-side, and said vessel has a solution flow inlet and a clean stream outlet.

8. The electrowinning cell according to claim 7, which further comprises a recirculation pump within an inlet connected to a first port of said vessel and an outlet connected to a second port of said vessel.

9. The electrowinning cell according to claim 7, wherein said conductive filaments are wire, mesh or matte.

10. The electrowinning cell according to claim 9, wherein said anode is comprised of graphite.

11. The electrowinning cell according to claim 7, wherein at least one semipermeable membrane is disposed between said cathode and anode.

12. The electrowinning cell according to claim 7, which further comprises a plurality of plate cathodes and anode alternatively oriented side-by-side.

13. The electrowinning cell according to claim 12, wherein at least one semipermeable membrane is disposed between said cathode and anode.

14. The electrowinning cell according to claim 7, which is disposed of an electrowinning dissolution system.

15. An electrowinning process comprising the steps of:

a. dissolving a contaminated metal into an electrolyte to form a solution flow of metal and contaminants;

b. oxidizing at least a portion of said solution contaminants;

c. plating said solution metal onto a cathode comprised of a porous form of one or more conductive filaments to produce a clean stream;

d. stripping an oxidant from said solution flow after said oxidizing step, wherein said oxidizing step comprises adding an oxidant to said solution flow;

e. adsorbing said oxidized solution contaminants from said solution flow after said stripping step; and f. using said clean stream as said electrolyte in said dissolving step.

16. The process of claim 15, wherein said plating step comprises plating said solution metal onto said cathode comprised of a porous form of wire, mesh, or matte.

17. The process of claim 15, further comprising the step of harvesting said porous form of conductive filaments when a pressure drop therethrough is above a harvest limit;

wherein said plating step comprises directing said solution flow through said porous form of said cathode.

18. The process of claim 17, wherein said plating step further comprises directing said solution flow through an electrowinning cell comprising said cathode, an anode, and at least one semipermeable membrane disposed therebetween.

* * * * *